US008171863B2

(12) United States Patent
Nyenhuis et al.

(10) Patent No.: US 8,171,863 B2
(45) Date of Patent: May 8, 2012

(54) FLIP-TOP TABLE MECHANISM

(75) Inventors: Jack Nyenhuis, Jenison, MI (US); Matthew Ruster, Holland, MI (US); Tod Babick, Grand Rapids, MI (US); Gary Petertyl, East Grand Rapids, MI (US); Bradley DeBruyne, Walker, MI (US)

(73) Assignee: DSA International, Inc., Zeeland, MI (US)

( * ) Notice: Subject to any disclaimer, the term of this patent is extended or adjusted under 35 U.S.C. 154(b) by 1085 days.

(21) Appl. No.: 12/031,009

(22) Filed: Feb. 14, 2008

(65) Prior Publication Data

US 2009/0205541 A1 Aug. 20, 2009

(51) Int. Cl.
*A47B 3/00* (2006.01)

(52) U.S. Cl. ..... 108/115

(58) Field of Classification Search ..... 358/1.15; 108/115, 150, 124, 125, 127, 128, 129, 131, 108/132, 133, 134; 248/188.6, 188.1, 168, 248/170

See application file for complete search history.

(56) References Cited

U.S. PATENT DOCUMENTS

| | | | | | |
|---|---|---|---|---|---|
| 120,550 | A | | 10/1871 | Thornton | |
| 1,203,783 | A | | 11/1916 | Reischmann | |
| 1,752,304 | A | | 4/1930 | Kovats | |
| 1,938,507 | A | * | 12/1933 | Wilson | 108/115 |
| 1,979,568 | A | * | 11/1934 | Bales et al. | 108/125 |
| 2,121,398 | A | | 6/1938 | Dukes | |
| 2,978,895 | A | | 4/1961 | Heisler | |
| 3,166,029 | A | | 1/1965 | Acton | |
| 3,349,728 | A | | 10/1967 | Barecki | |
| 3,641,946 | A | | 2/1972 | Channay | |
| 3,796,169 | A | | 3/1974 | Bales | |
| 3,993,004 | A | | 11/1976 | Alme | |
| 4,643,105 | A | | 2/1987 | Baum | |
| 4,773,337 | A | | 9/1988 | Ball | |
| 4,838,181 | A | | 6/1989 | Luyk | |
| 4,879,954 | A | * | 11/1989 | Sawamura et al. | 108/6 |
| 4,986,195 | A | | 1/1991 | Diffrient | |
| 5,121,697 | A | | 6/1992 | Baum | |
| 5,174,225 | A | | 12/1992 | Reise | |
| 5,205,223 | A | | 4/1993 | Ball | |
| 5,323,713 | A | | 6/1994 | Luyk | |
| 5,354,027 | A | | 10/1994 | Cox | |
| 5,673,633 | A | | 10/1997 | Pfister | |
| 5,927,214 | A | * | 7/1999 | Schwartz et al. | 108/115 |
| 6,006,880 | A | | 12/1999 | Daniel | |
| 6,336,414 | B1 | | 1/2002 | Stewart | |
| 6,394,005 | B1 | | 5/2002 | Isensee | |
| 6,637,352 | B1 | | 10/2003 | Thode | |
| 6,845,723 | B2 | | 1/2005 | Kottman | |
| 7,007,587 | B2 | | 3/2006 | Zanden | |
| 7,350,469 | B2 | * | 4/2008 | Koning et al. | 108/115 |
| 7,546,810 | B2 | * | 6/2009 | Hernandez | 108/115 |
| 7,677,184 | B2 | * | 3/2010 | Dhanoa et al. | 108/115 |
| 7,765,938 | B2 | * | 8/2010 | Piretti | 108/115 |
| 7,845,290 | B2 | * | 12/2010 | Piretti | 108/115 |
| 2003/0167980 | A1 | * | 9/2003 | Suzuki | 108/129 |
| 2005/0235886 | A1 | | 10/2005 | Koning | |
| 2007/0256611 | A1 | * | 11/2007 | Huang | 108/116 |
| 2009/0283020 | A1 | * | 11/2009 | Hsu | 108/115 |

* cited by examiner

*Primary Examiner* — Jose V Chen
(74) *Attorney, Agent, or Firm* — Dowell Baker, P.C.

(57) ABSTRACT

An improved mechanism for operating a flip-top table is presented that provides improved table rigidity, an intuitively operable release mechanism, a single release action to release the mechanism from both a "use" and "folded" position, and spatially separated latches for the "use" and "folded" positions. Additionally the mechanism meets or exceeds government and industry standards while having a refined appearance.

21 Claims, 8 Drawing Sheets

FLIP-TOP TABLE MECHANISM

FIELD OF THE INVENTION

The present invention relates generally to a mechanism for adjusting the tilt of a top surface, and more particularly to a mechanism for a flip-top table having improved stability, robustness, ease of use, and ease of manufacture.

BACKGROUND OF THE INVENTION

Tables with titling tops are well known in the art. Designers of flip-top tables, however, have faced many challenges in designing the mechanism that allows the top to tilt and preferably lock in place. First, the rigidity of a flip-top table must be comparable to conventional non-flip tables. Second, the mechanism must be simple to manufacture and preferably accommodate a variety of leg and table top sizes so that a single style of mechanism may be manufactured for multiple table designs.

Third, the mechanism must allow the table to fold in a manner so that the table may pass through a standard doorway. Fourth, the mechanism must be able to satisfy government regulations, such as those set by OSHA, and non-governmental organization's standards, such as the Business and Institutional Furniture Manufacturer's Association.

Fifth, pinch points at the location of mechanism activation must be minimized to reduce the risk of injury to the table operator. Sixth, the operation of the mechanism should be intuitive and a single or dual operation should be used for releasing the table top from multiple positions.

Seventh, the mechanism must latch when the table is in a "use" position and the mechanism must latch or clip when the table is in a "folded" position. Eighth, the mechanism must provide a signal to the operator that the mechanism has locked. A preferable signal to the operator is an audible sound.

Ninth, the mechanism must be difficult to accidentally activate when it is bumped or kicked by a person using the table. Tenth, the design of the mechanism must work with a free-swinging modesty panel.

Eleventh, the mechanism should inhibit bidirectional rotation about a rotation axis when the table is in the "use" and "folded" positions. Twelfth, the mechanism may be used to limit the speed of rotation of the table top when the table is transitioning between positions.

Finally, the mechanism should be constructed from lightweight yet robust materials. The mechanism should utilize unique latching features for each unique configuration because utilizing different portions of the mechanism helps to evenly spread the wear on the mechanism. Utilizing separate features for each latching position also allows the mechanical tolerances of the design and table wobble to be reduced. Additionally, separate features may be individually customized (strengthened, etc.) based on conditions t he table will experience in a specific configuration.

There have been many attempts to address these challenges faced by designers of flip-top table mechanisms. For example, U.S. Pat. No. 1,203,783 issued to Reischmann and U.S. Pat. No. 3,641,946 issued to Charnay disclose lockable mechanisms for pivoting tables. The mechanisms have springs that are securable to a plurality of rods or holes, with each rod or hole corresponding to a unique table position. The '783 and '946 patents, however, do not provide unique spatially separated latching features since one spring interacts with all the rods or holes. Additionally, the latching mechanisms of the '738 and '946 patents are only functional with one type of table leg because the legs are integrated into the mechanisms, thus the need remains for an improved flip-top table mechanism.

U.S. Pat. No. 4,986,195 issued to Diffrient discloses a "tilting table top mechanism . . . [with] a chassis member which is secured to the underside of a table top and a base plate which is secured to the top of a table leg . . . . A dual locking mechanism maintains the table top in its normal 'use' position but is manually disengaged with ease." The mechanism of the '195 patent does not bi-directionally lock the rotation of the table in a folded configuration, thus the need remains for an improved flip-top table mechanism.

U.S. Pat. No. 3,796,169 issued to Bales and Estes discloses a flip-top table mechanism that utilizes unique portions of the latch for each configuration of the table. However, the mechanism of the '169 patent has several pinch points near the activation point of the mechanism.

Accordingly, an object of the present invention is to provide an easily manufacturable mechanism for a flip-top table with rigidity comparable to a non flip-top table.

Another object of the present invention is to provide an intuitively operable mechanism that meets government and industry standards.

Yet another object of the present invention is to provide a flip-top table mechanism that is capable of locking a table in both a use and folded position.

Still another object of the present invention is to provide a mechanism that gives an audible signal when locking.

A still further object of the present invention is to provide a single release mechanism capable of releasing the table top from both a folded and a use position while being difficult to accidentally engage.

SUMMARY OF THE INVENTION

The present invention provides an improved mechanism for operating a flip-top table. While maintaining the benefits of standard mechanisms, the mechanism of the present invention also achieves many benefits including improved table rigidity, an intuitively operable release mechanism, a single release action for both the "use" and "folded" positions, and spatially separated latches for the "use" and "folded" positions. Additionally the present invention provides a mechanism that meets or exceeds government and industry standards and has a refined appearance.

DETAILED DESCRIPTION

The present invention may be used with any type of flip-top structure and is particularly suited for applications requiring a lightweight, rigid, and robust mechanism with a intuitively operated release action. The improved flip-top table mechanism of the present invention may be used with flip-top objects such as chairs, tables, stadium seating or benches. However, for descriptive purposes, the present invention will be described in use with a flip-top table.

Figure 1:
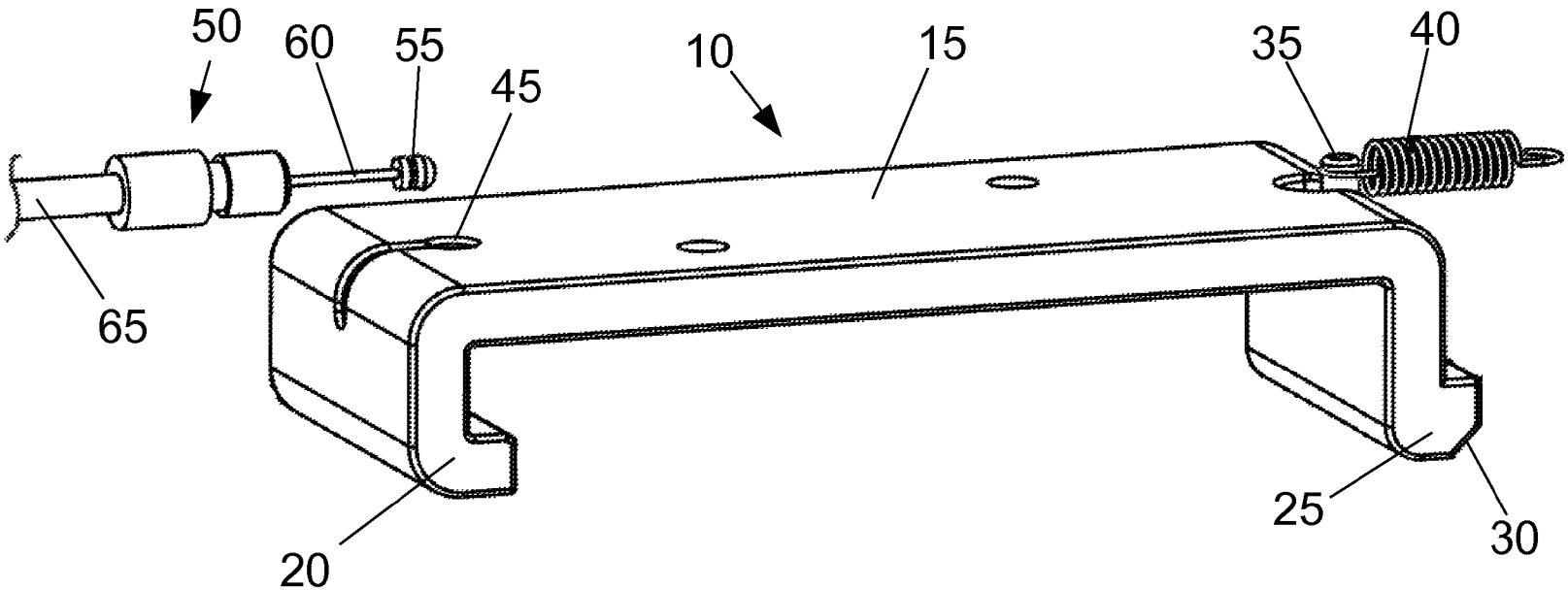
FIG. 1 is a perspective view of a latching piece connected to a spring and cable line.

FIG. 1 shows a perspective view of a latching piece 10 having a substantially flat main section 15. The storage latch 20 and the use latch 25 extend from the main section of the latching piece. The use latch 25 has an angle surface 30 that allows the use latch to fit into confined locations. The latching piece has a knob 35 that is connected to a spring 40. The spring functions to pull the latching piece towards the spring. The latching piece also has a groove 45 into which a cable assembly 50 with a cylinder 55 connected to a cable 60 may be inserted. In the preferred embodiment of the invention, the cable 60 is thread through a cable housing 65. The cable assembly 50 is capable of pulling the latching piece in the opposite direction of the spring 40.

The storage latch and the use latch may be significantly different in shape or size depending on the forces expected to act upon the mechanism when the table is in the various configurations. For example, the storage latch may be reinforced if it is expected that the table top will be bumped while in the folded configuration. Conversely, the storage latch may be significantly thinner than the use latch if the mechanism is designed for a table that is only briefly put into the folded position on rare occasions.

A spring is shown pulling on the latching piece, however a variety of pulling means such as magnets, belts, ropes connected to weights, and rubber bands may be used to pull upon the latching piece.

Although the cable assembly connects to a groove in FIG. 1, a variety of mechanisms may be used to connect the cable to the latching piece. For example, the cable assembly may connect to a knob or latch. Portions of the cable may also be integrally incorporated into the latching piece. Other systems such as a hydraulic line may be employed to push or pull upon the latching piece.

Figure 2:
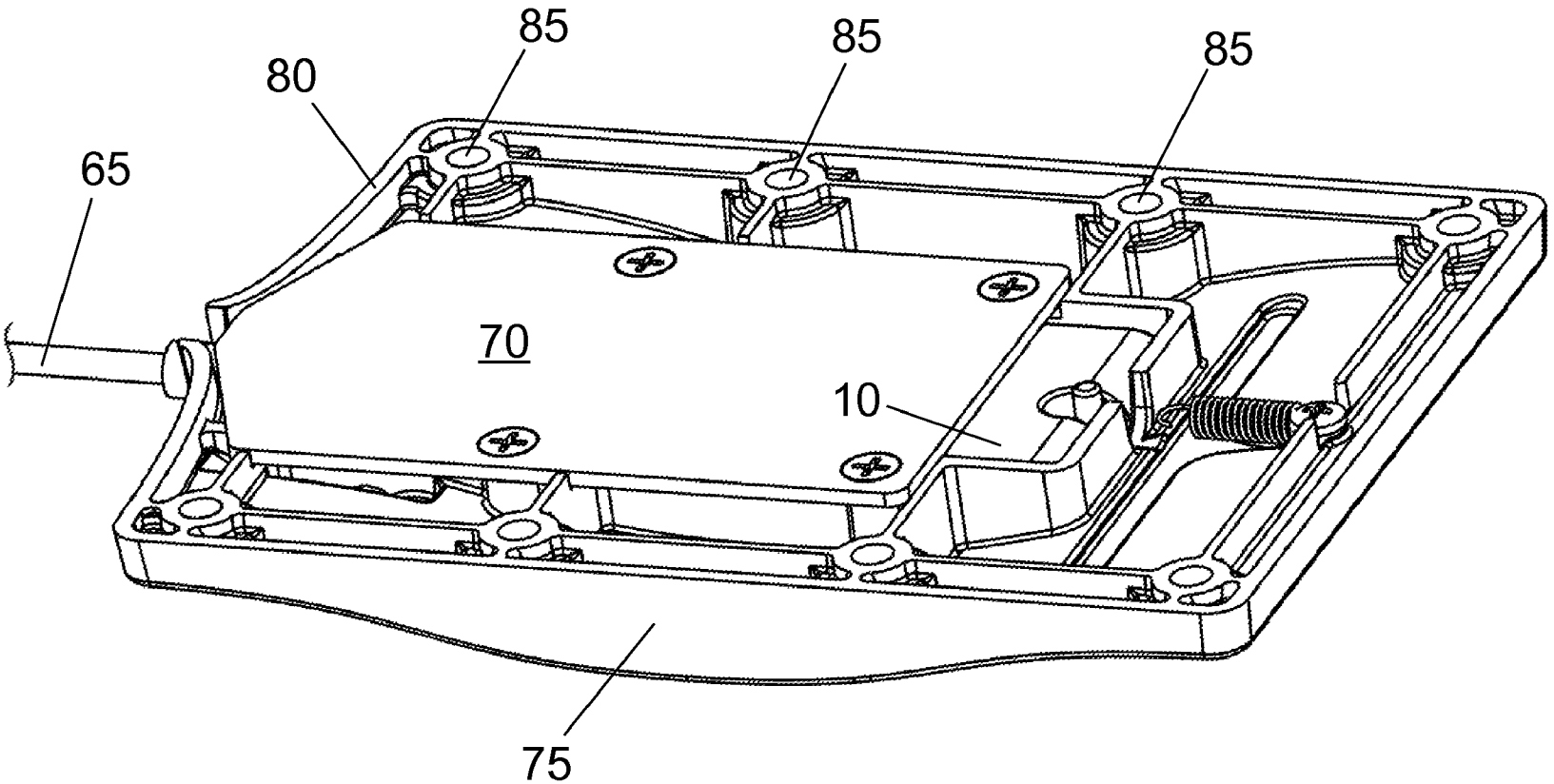
FIG. 2. is a perspective view of a latching piece substantially enclosed between a top plate and a cover.

FIG. 2 is a perspective view of a cover 70 and top plate 75 substantially enclosing the main section of the latching piece 10. The cover and top plate comprise a top plate assembly. The use latch and the storage latch are not substantially enclosed by the top plate assembly. The cover and top plate have a substantially flat top 80 capable of being pressed flush against a flat bottom of a table top. The top plate 75 also includes through holes 85 through which fasteners may pass to secure the table top to the top plate 75. Other features for securing a table top to the top plate may be incorporated. For example, features in the top plate may facilitate nailing, stapling, bolting, welding, riveting or gluing the table top to the top plate. The top plate may also include rare earth magnets for magnetically connecting the table top to the top plate.

Figure 3:
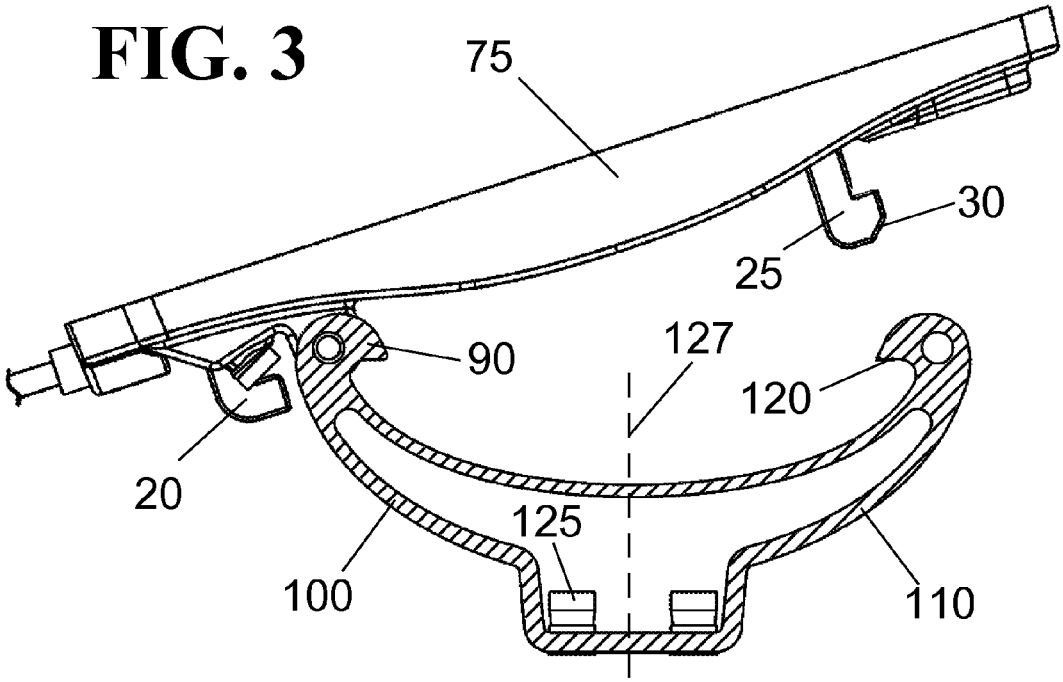
FIG. 3 is a side sectional view of a top plate connected by a hinge to a base piece.
Figure 4:
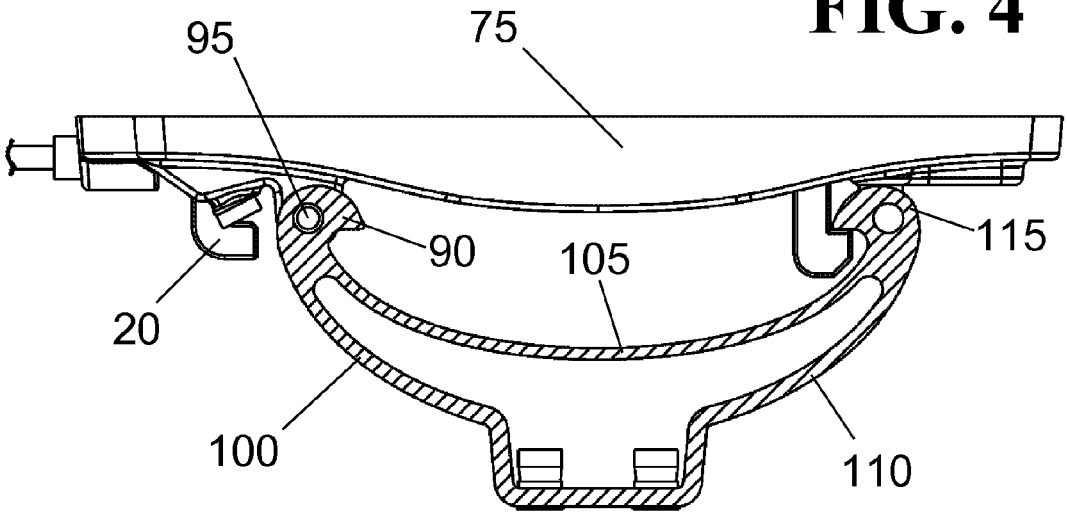
FIG. 4 is a side sectional view of a latching piece locked to a base piece.

FIGS. 3 and 4 are side sectional views of a latching piece unlocked and locked to a base piece, respectively. The base piece has a substantially rounded hinge area 90 where the top plate 75 may be rotated about an axis of rotation 95 with respect to the base piece. A hinge area support 100 and a main support 105 connect to the hinge area of the base piece. The main support 105 and a latch area support 110 are connected to a latch area 115 that includes a latching ledge 120. The latching ledge 120 has a shape designed to interact with the use latch 25. The angled surface 30 of the use latch 25 is substantially matched to the curvature of the main support 105 as shown in FIG. 4. When the mechanism is transitioning into a use configuration the angled surface 30 interacts with the rounded latch area 115. The interaction pushes the use latch 25 towards the hinge area 90 thereby allowing the use latch 25 to extend past the latching ledge 120. When the use latch snaps past the latching ledge, an audible sound may be created. The base piece may also include rivets 125 that are capable of securely connecting table legs to the base piece.

The base piece is preferably constructed as a unitary piece from an extrusion process or other mass manufacture process. The base piece may be constructed having a mirror plane 127 to reduce design and manufacture costs for the base piece. The mirror plane also serves to provide a base piece of refined appearance.

The spatial separation of the hinge area and the latch area on the base piece serves to increase the structural rigidity of the table by minimizing the effects of any movement or gaps between the use latch and the latching edge. Assuming the latching mechanism is positioned at the center of a table, the total wobble at the end edge of the table is approximately:

$$\text{Table Wobble} = \frac{\frac{1}{2}\cdot\text{Table Width}\cdot\text{Ledge Wobble}}{\text{Distance}}$$

Where Table Wobble is the vertical wobble at the edge of the table due to the latching mechanism, Table Width is the width of the table, Ledge Wobble is the difference between the minimum and maximum vertical distance between the latching edge and the use latch, and Distance is the separation between the hinge area and the latch area. As clearly shown, increasing the separation between the hinge area and the latching area has a significant impact on the stability of a flip-top table.

The components of the mechanism may be constructed from a wide variety of materials such as plastics, metals, natural materials, and composite materials. Materials contemplated by the inventor include molded glass, fiberglass, nylon, glass material, stamped steel, stamped aluminum, carbon/nylon reinforced textile sheets, amarid, polyester, and carbon fiber. For components created by an extrusion process, the resins contemplated by the inventor include epoxy, unsaturated polyester, urethane acrylate, vinyl ester, phenol, polyurethane, a thermoplastic resin, nylon 6, nylon 66, nylon 12, PBT, PET, polycarbonate, polyacetal, polyphenylene sulfide, polyether ether ketone, polyether sulfide, polyphenylene oxide, modified polyphenylene oxide, polypropylene, and polyvinyl chloride, ethylene-vinyl acetate copolymer, polystyrene, acrylonitrile-butadiene-styrene copolymers (ABS), 6, 11, 12, 6-6 and 6-10 polyamides, poly(ether amide)

sequenced copolymer, fluorinated polymers, polysulfone, polyethersulfone, polycarbonate, polyetheretherketone, polyphenylene sulfur, polyetherimide, and polyphenylene ether.

Figure 5:
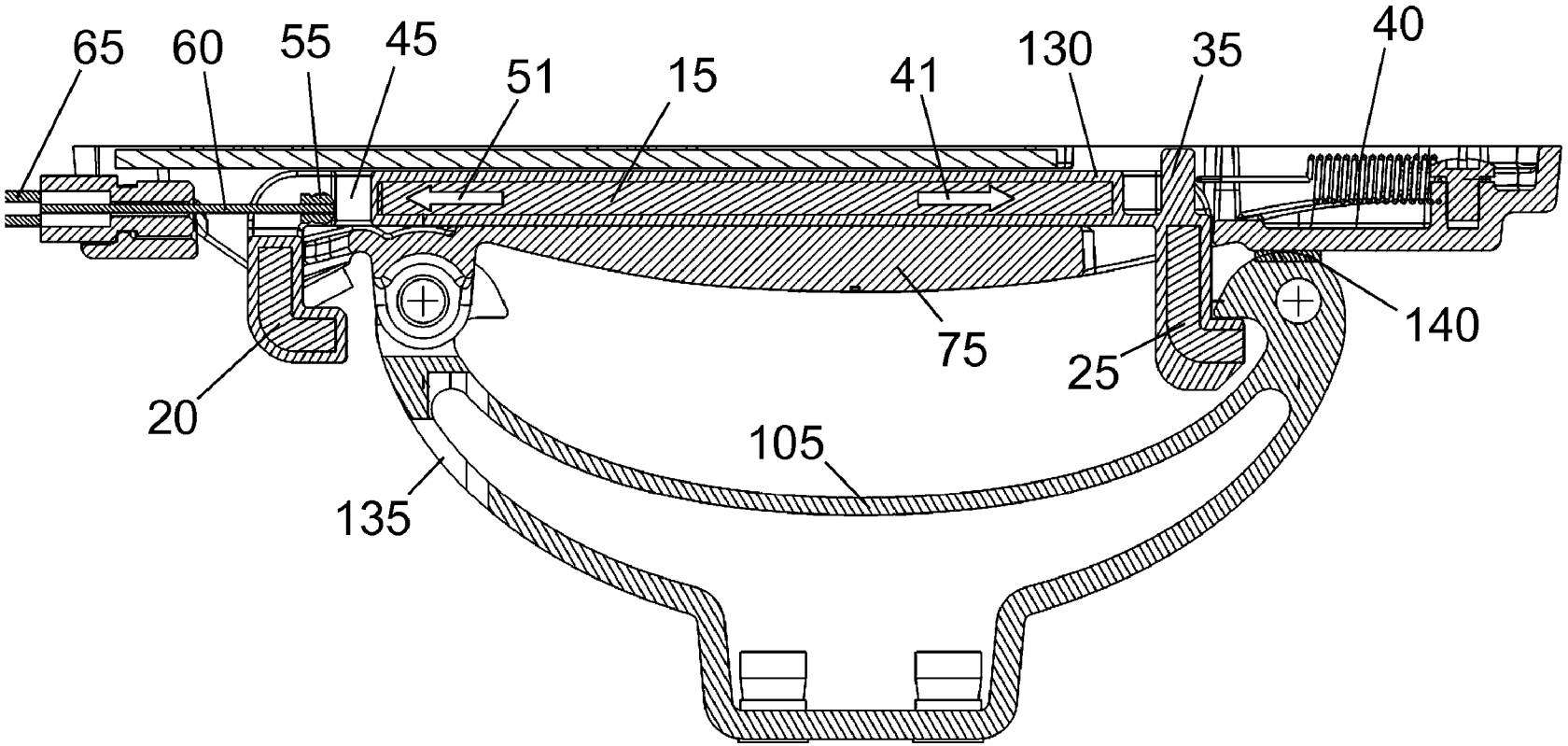
FIG. 5 is a side sectional view of a latching piece locked to the ledge of a base piece.
Figure 6:
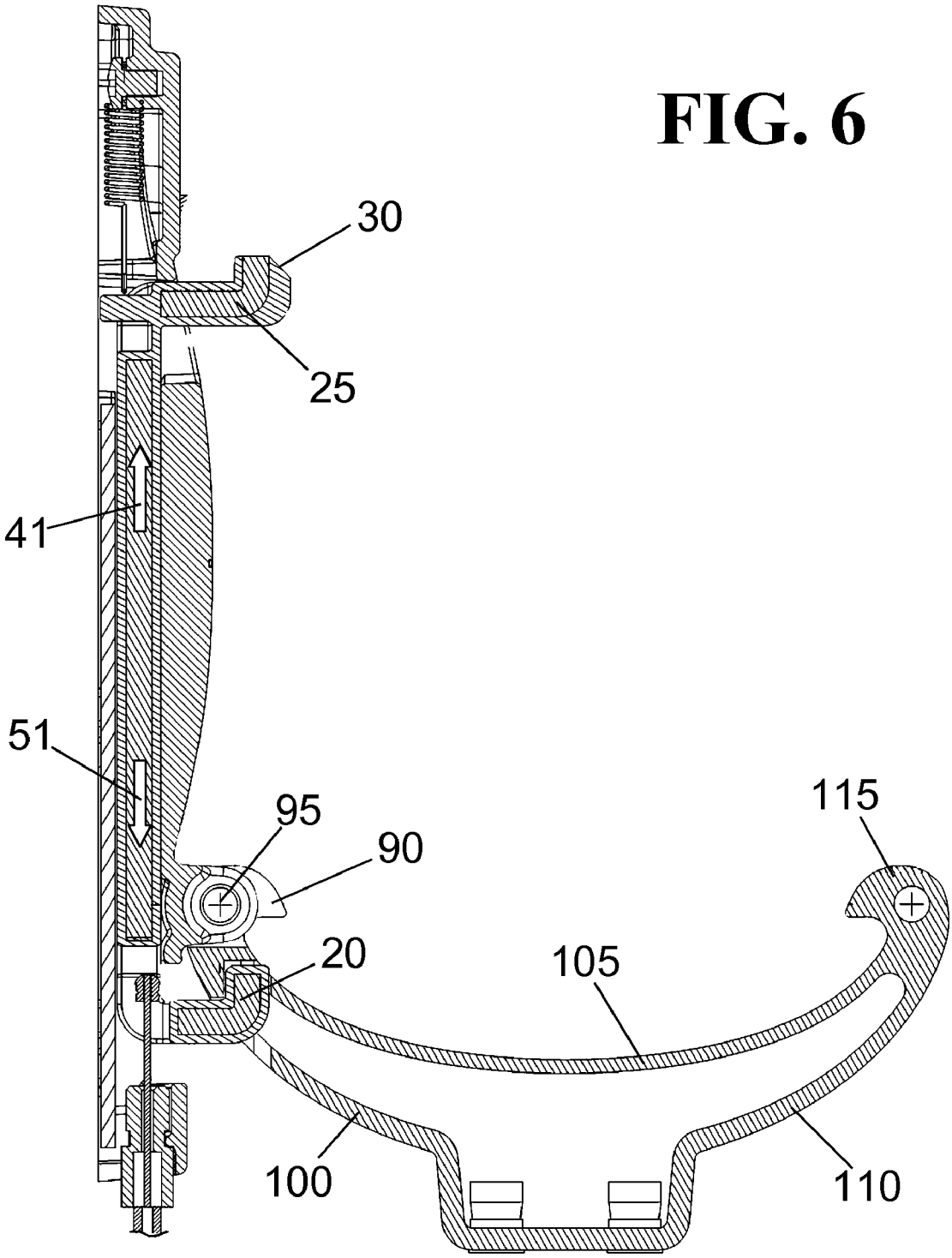
FIG. 6 is a side sectional view of a latching piece locked to the hole of a base piece.

FIGS. 5 and 6 show additional sectional views of the locking mechanism. The latching piece has a knob 35 that is connected to a spring 40. The spring functions to pull the latching piece towards the spring. The direction of movement of the latching piece 10 through the top plate 75 due to the spring 40 is highlighted with the spring arrow 41. The cable assembly 50 is capable of pulling the latching piece in the opposite direction of the spring 40. The direction of movement of the latching piece 10 through the top plate 75 due to the cable assembly 50 is highlighted with the cable arrow 51. The main section 15 of the latching piece shown in FIG. 5 has an outer coating 130 designed to reduce friction as the latching piece slides back and forth through the top plate assembly. The preferred outer coatings of the latching piece are Teflon or Nylon, however the use of other materials such as metals, plastics, and natural materials are within the scope of the invention. The base piece includes a hole 135 designed to accept the storage latch 20 when the table is in a folded configuration.

As shown in FIG. 6, when the latching mechanism is in a folded configuration the interaction of the storage latch 20 with the hinge area support 100 prevents clockwise rotation (as illustrated) of the top plate around the axis of rotation 95. The interaction of the main support 105 with the storage latch 20 prevents counterclockwise rotation of the top plate. The storage latch 20 may be withdrawn from the hole 135 by the cable 60 and cylinder 55 pulling the latching piece towards the cable housing 65. When the mechanism is transitioning into a folded configuration the storage latch 20 interacts with the rounded surface of the hinge area support 100. The interaction pushes the storage latch 20 away from the hinge area 90 thereby allowing the storage latch 20 to extend into the hole in the base piece. When the storage latch snaps into the hole, an audible sound may be created.

Figure 7:
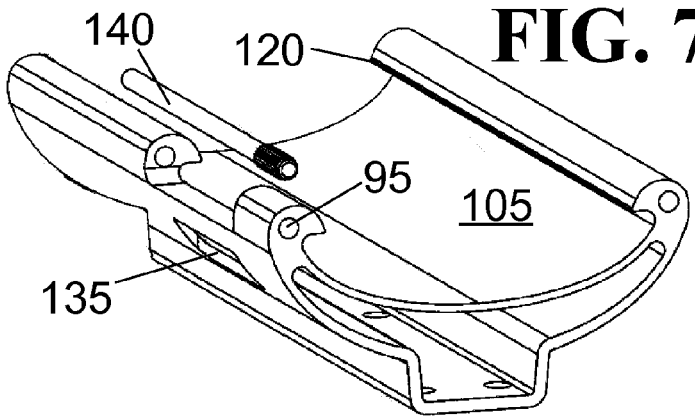
FIG. 7 is a perspective view of a base piece with a ledge and hole adapted for interlocking with a latching piece.
Figure 8:
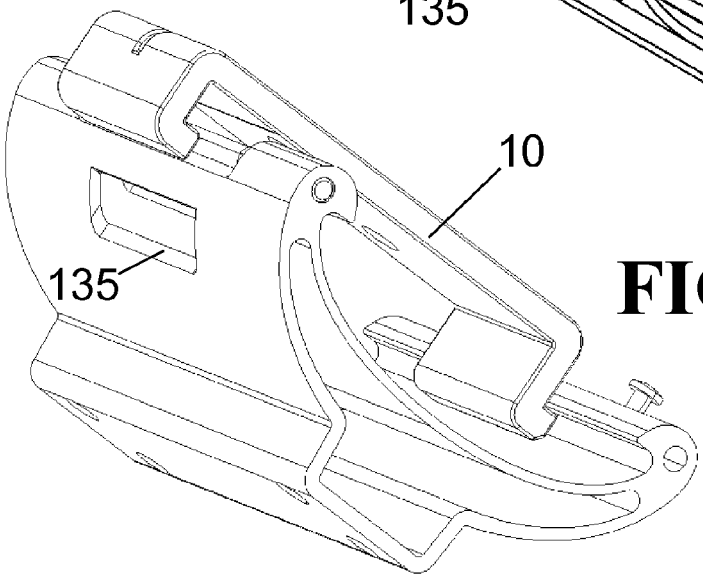
FIG. 8 is a perspective view of perspective view of a latching piece locked to base piece.
Figure 9:
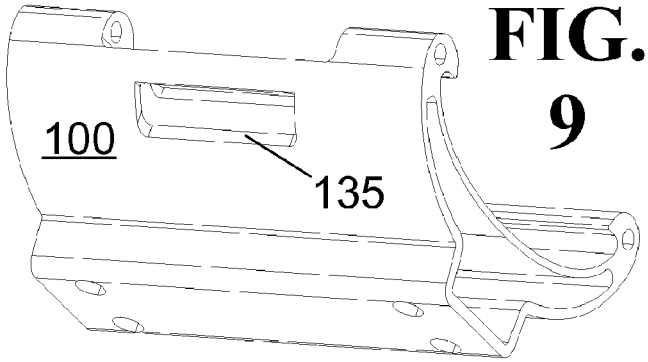
FIG. 9 is a perspective view of a base piece highlighting the hole in the hinge area support area of the base piece.
Figure 10:
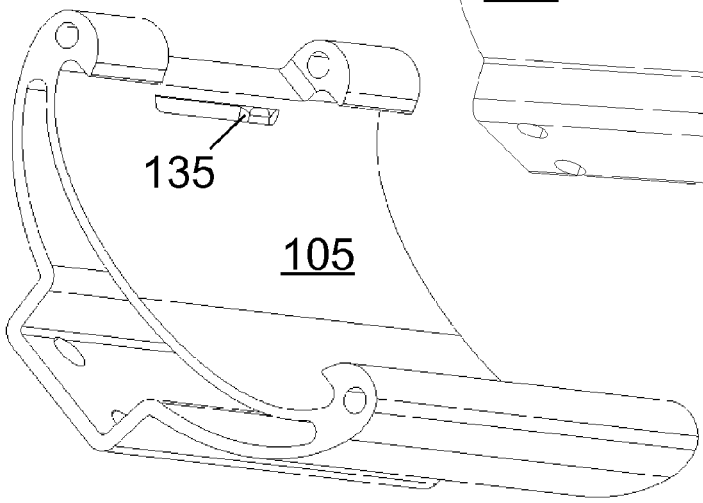
FIG. 10 is a perspective view of a base piece highlighting the hole in the main support area of the base piece.

FIGS. 7, 8, 9, and 10 show perspective views of a base piece. FIGS. 7 and 8 show a hinge piece 140 that rotates the top plate about an axis of rotation 95. FIG. 7 also shows the ledge 120 where the latching piece is latched when the mechanism is in the "use" position and the hole 135 where the mechanism latches in the "folded" position. FIGS. 9 and 10 further highlight the hole where the mechanism latches in the folded position.

Figure 11:
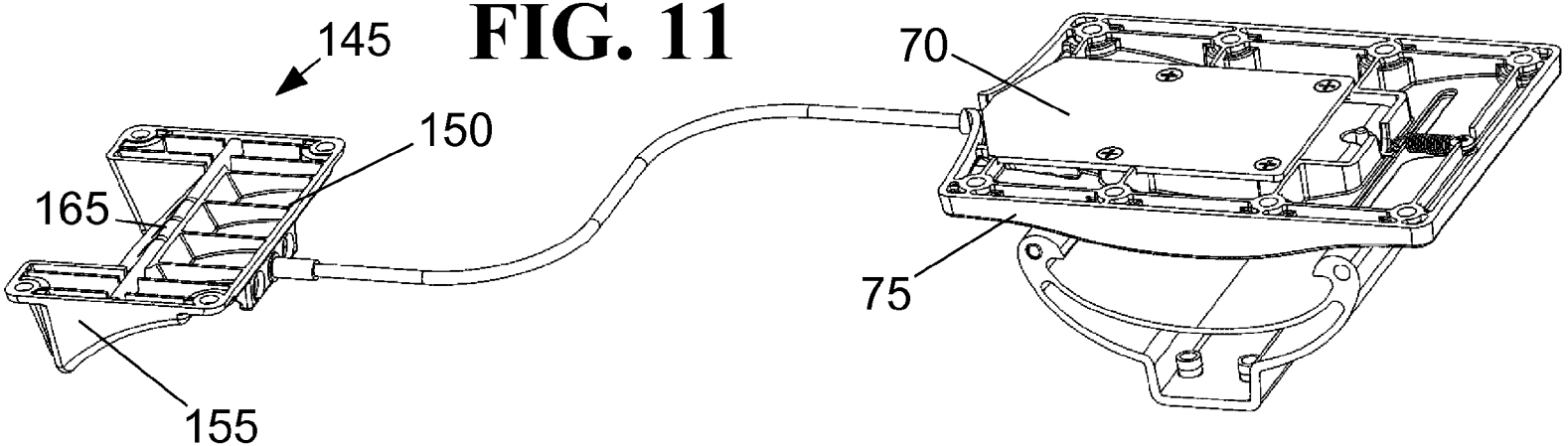
FIG. 11 is a perspective view of a latching piece connected to a cable assembly that is connected to a handle release having features to prevent the accidental disengagement of the latching piece.
Figure 12:
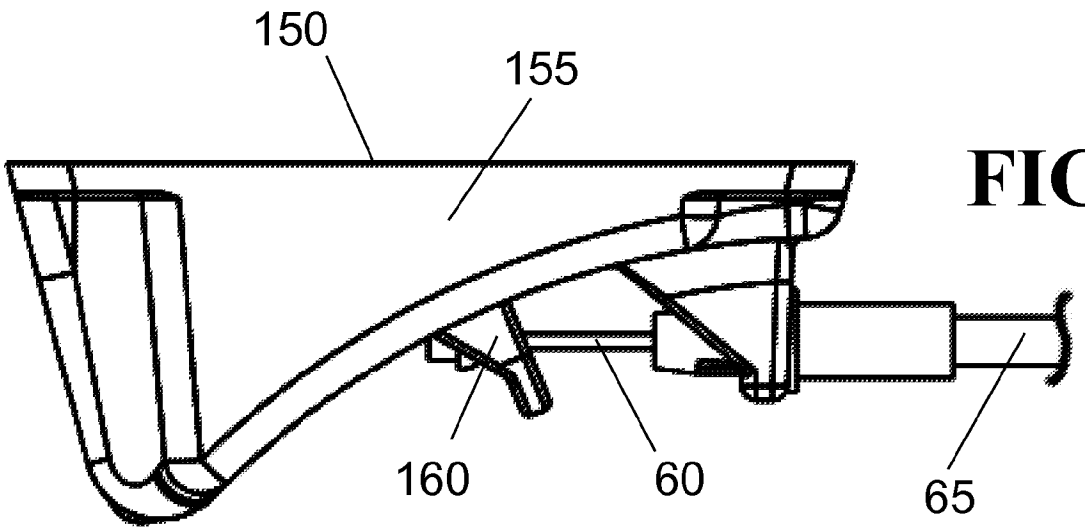
FIG. 12 is a side view of a handle release.

FIGS. 11 and 12 show a base piece, a cover 70 and a top plate connected by a cable assembly to a release assembly 145. The release assembly has a smooth top 150, similar to the top plate 70, designed to be positioned flush against a table top bottom. The release assembly also has guard features 155 such as rounded protrusions that reduce the likelihood of the mechanism being accidentally released by a user kicking or bumping against the release mechanism. A lever 160 connected to a hinge 165 in the release mechanism is used to pull against the cable 60. The use of a lever and a hinge reduces the amount of force that a user must exert on the mechanism to release the latching piece. In the preferred embodiment of the invention, approximately 5 pounds of force is required to release the latching piece from either the "use" or "folded" position.

Figure 13:
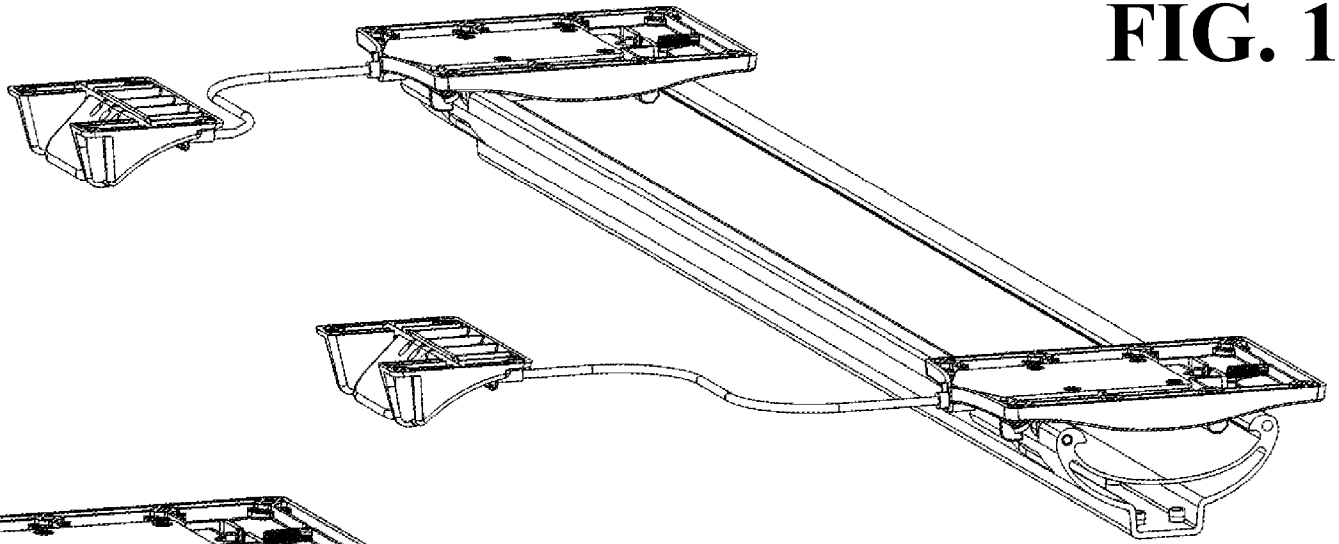
FIG. 13 is a perspective view of two handle releases operating two latching pieces that are connected to a single base piece.
Figure 14:
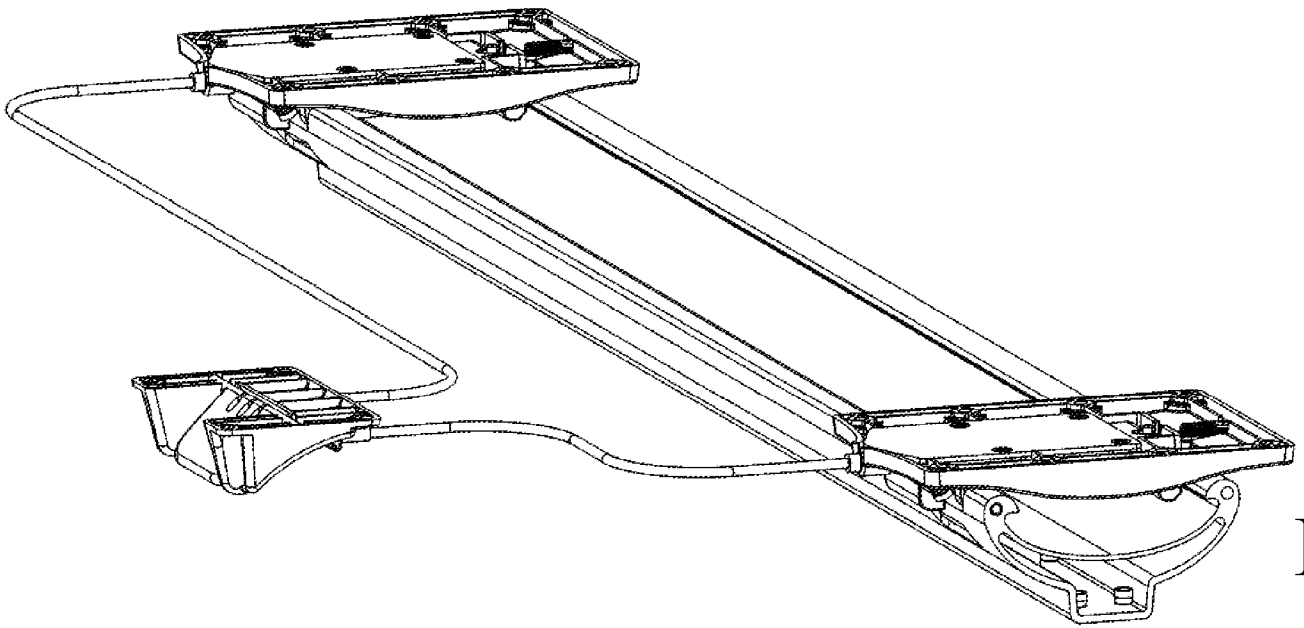
FIG. 14 is a perspective view of a single handle release operating two latching pieces that are connected to the same base piece.

FIGS. 13 and 14 show two latching mechanisms connected to a single base piece. In FIG. 13, two independent release mechanisms are used to operate two latching pieces while in FIG. 14, a single release mechanism operates both latching mechanisms. Although two latching mechanisms are shown in FIGS. 13 and 14, the use of many latching mechanisms connected to a single base piece is contemplated by the inventor. When many latching mechanisms are connected to a single base piece, each latching mechanism may be independently controlled by a release mechanism, all the latching mechanisms could be controlled by a single release mechanism, or multiple release mechanisms could control groups of latching mechanisms.

The inventor contemplates several alterations and improvements to the disclosed invention. The latching and release mechanisms may further include protective and/or decorative coatings such as paint. Other alterations, variations, and combinations are possible that fall within the scope of the present invention. For example a spring may be added between the base piece and the top plate so that the mechanism will automatically transition from a "use" position to a "folded" position when the latching piece is released from the ledge. Although various embodiments of the present invention have been described, those skilled in the art will recognize more modifications that may be made that would nonetheless fall within the scope of the present invention. Therefore, the present invention should not be limited to the apparatus described. Instead, the scope of the present invention should be consistent with the invention claimed below.

We claim:

1. A flip top table comprising:

a top plate secured to table top a table leg secured to a base with a fastener;

the base having a first support extending away from the fastener to a ledge and a second support extending away from the fastener and first support to a hinge connected to the top plate, the second support having a hole between the hinge and the fastener;

a latching mechanism slidable through the top plate parallel to a bottom surface of the table top, the latching mechanism selectively locking the table into a folded configuration or a use configuration;

in the use configuration, a first latching portion of the latching mechanism contacting the ledge; and in folded configuration, a second latching portion of the latching mechanism located in the hole and the first latching portion of the latching mechanism distant from the base;

wherein a common release mechanism acts to release the latching mechanism from both the use configuration and the folded configuration.

2. The flip top table of claim 1 further comprising:

the latching mechanism substantially fixed at a distance relative to the bottom surface of the table top.

3. The flip top table of claim 2 further comprising:

the first latching portion distant from the second latching portion.

4. The flip top table of claim 1 further comprising:

the latching mechanism preventing clockwise and counter clockwise rotation of the table top about the hinge when the table has the folded configuration; and the latching mechanism preventing clockwise and counter clockwise rotation of the table top about the hinge when the table has the use configuration.

5. The top table mechanism of claim 4 further comprising:

the latching mechanism extending substantially across the base.

6. A flip top table comprising:

a table top;

a base having a fastener portion for securing a table leg to the base, a latch support portion extending from the fastener portion and including a ledge, a hinge support portion extending from the fastener portion away from the latch support portion, the hinge support portion having a hole;

the base connected to a top plate connected to the table top;

a latching mechanism slidable through a top plate secured to the table top, the latching mechanism selectively locking the table into a folded configuration or a use configuration;

the latching mechanism having a first latching portion and a second latching portion, the first latching portion distant from the second latching portion, the first latching portion engaging the hole when the table has the folded configuration, the second latching portion engaging the ledge when the table has the use configuration, wherein a common release mechanism acts to release the latching mechanism from both the use configuration and the folded configuration.

7. The flip top table of claim 6 further comprising:

the first latching portion distant from the hole when the table has the use configuration, and the second latching portion distant from the ledge when the table has the folded configuration.

8. The flip top table of claim 6 further comprising:

an axis of rotation about which the base and the top plate may rotate, the base located between the latching mechanism and a table leg below, the table leg distant from the axis of rotation.

9. The flip top table of claim 8 further comprising:

the common release mechanism including a flexible transmission line connecting to a the latching mechanism, the flexible transmission line further connecting to a lever.

10. The flip top table of claim 6 further comprising:

the latching mechanism having a coating of polytetrafluoroethylene.

11. The flip top table of claim 6 further comprising the top plate having a spring pulling the latching mechanism in a first direction, and a cable pulling the latching mechanism in a second direction.

12. The flip top table of claim 6 further comprising the ledge extending towards the hinge.

13. The flip top table of claim 1 further comprising the top plate having a spring pulling the latching mechanism in a first direction, and a cable pulling the latching mechanism in a second direction.

14. A table assembly comprising: a latching mechanism connecting to a table top and a table leg, the latching mechanism further comprising:

a top plate assembly connecting to the table top;

a latching piece having a main section at a substantially fixed distance from the table top, the main section slidable in a first direction and a second direction through the top plate, the main section having a main surface extending parallel relative to the table top; top, a latching protrusion extending from the main section substantially normal to the main surface, a first projection extending from the latching protrusion in substantially the first direction, a storage protrusion extending from the main section substantially normal to the main surface, the storage protrusion distant from the latching protrusion, and a second projection extending from the storage protrusion in substantially the first direction;

a puller pulling the latching piece in substantially the first direction;

a release device capable of pulling the latching piece in the second direction;

a hinge connecting to the top plate assembly and a base piece, a portion of the hinge located between the latching protrusion and the storage protrusion;

the base piece connecting to the hinge and the table leg, the base piece having a fastener portion for secured to the table leg, a latch support portion extending from the fastener portion and including a ledge, a hinge support portion extending from the fastener portion away from the latch support portion, the hinge support portion having a hole, the first projection of the latching protrusion only engaging the ledge when the table assembly is in a use configuration, the second projection of the storage protrusion only engaging the hole when the table assembly is in a storage configuration.

15. The table assembly of claim 14 further comprising:

a single release mechanism selectively acting to disengage the second projection from the hole and selectively acting to disengage the first projection from the ledge.

16. The table assembly of claim 15 further comprising:

the single release mechanism including a lever connected to a cable assembly, the cable assembly connecting to the latching piece.

17. The table assembly of claim 15 further comprising:

the base piece having a base surface between the hole and the ledge, the latching protrusion having an angled surface substantially defined by the base surface.

18. The table assembly of claim 15 further comprising:

the base piece having a rounded surface proximal to the ledge, wherein the latching protrusion contacting the rounded surface slides the latching piece in the second direction.

19. The table assembly of claim 14 further comprising:

the latching piece having a coating of polytetrafluoroethylene.

20. The table assembly of claim 14 wherein relative to the base piece, the first direction in the storage configuration is perpendicular to the first direction in the use configuration.

21. The table assembly of claim 14 further wherein the latching protrusion extends from the main section away from the table top; and the storage protrusion extends from the main section away from the table top.

* * * * *